US005364056A

United States Patent [19]

Jiang

[11] Patent Number: 5,364,056

[45] Date of Patent: Nov. 15, 1994

[54] COMBINED BOOK HOLDER AND BOOKMARK

[75] Inventor: Curtis T. Jiang, San Francisco, Calif.

[73] Assignee: QLH USA, Inc., San Francisco, Calif.

[21] Appl. No.: 99,747

[22] Filed: Aug. 2, 1993

[51] Int. Cl.[5] ..... A47B 97/04

[52] U.S. Cl. ..... 248/447; 248/682; 281/42; 294/138; 294/141

[58] Field of Search ..... 248/444.1, 461, 447, 248/452, 685, 682, 460; 281/42; 294/138, 141

[56] References Cited

U.S. PATENT DOCUMENTS

| | | | |
|---|---|---|---|
| 1,379,612 | 5/1921 | Baver | 248/461 X |
| 3,041,774 | 7/1962 | Walker | 248/441.1 |
| 3,661,405 | 5/1972 | Brown | 281/42 |
| 3,701,332 | 10/1972 | Brooks | 116/119 |
| 3,833,197 | 9/1974 | Dyke | 248/441.1 |
| 3,897,037 | 7/1975 | Johnson et al. | 248/460 |
| 4,681,291 | 7/1987 | Holladay | 248/444 |
| 4,735,438 | 4/1988 | Demarest, Jr. | 281/42 |
| 4,767,094 | 8/1988 | Brown | 248/448 |
| 4,908,912 | 3/1990 | Grant | 24/67.11 |
| 4,932,680 | 6/1990 | Rivera | 281/42 |
| 5,152,553 | 10/1992 | Domingo | 281/42 |
| 5,165,722 | 11/1992 | Wong | 281/442 |
| 5,246,251 | 9/1993 | Evans | 281/42 |

FOREIGN PATENT DOCUMENTS

| | | | |
|---|---|---|---|
| 8807451 | 10/1988 | WIPO | 281/42 |

*Primary Examiner*—Ramon O. Ramirez

[57] ABSTRACT

A combined book holder and bookmark consists of a pair of right and left racks pivotally joined to provide means to hold open a book, to mark a specific page, as well as to store a closed book for carrying.

6 Claims, 1 Drawing Sheet

COMBINED BOOK HOLDER AND BOOKMARK

BACKGROUND OF THE INVENTION

1. Field of Invention

This invention relates to a book holder for holding open a book, being usable as a bookmark and employed to store a closed book for carrying.

2. Description of Prior Art

A common problem with known type book holders is in the fact that they offer very little appeal to the user as an item with multiple nifty and handy features which often times is very important as long as convenience and practicability are concerned. To the best of my knowledge, no prior art book holder which is of an inexpensive, simple, light and easy to use construction, and which may be used as a bookmark and has means to store or carry a book and to receive advertising matters.

SUMMARY OF THE INVENTION

The main object of the present invention is to provide a book holder for use on paperback books, and the like, which enables a reader to hold the book open in a readable position without the use of both hands.

Another object of the present invention is to provide a book holder which can also be used as a bookmark or as a storing and carrying means when the book is closed.

An additional object of the present invention is to provide a book holder which is simple in construction, of low cost, and easy to use.

Yet another object of the present invention is to provide a book holder which has a roomy body surface for having attractive and/or advertising material imprinted thereon.

Still other features and advantages of the present invention will become apparent in view of the following description of the drawings and appended claims.

DETAILED DESCRIPTION OF THE DRAWINGS

Figure 1:
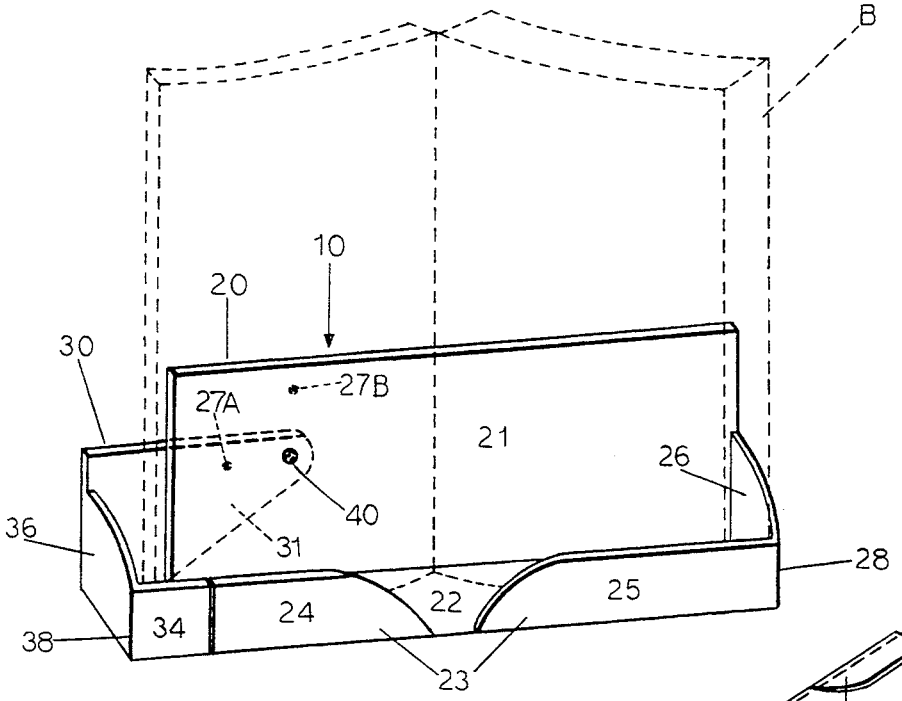
FIG. 1 is a perspective view of a book holder of the invention holding open a book depicted in dashed lines by means of a closed-end combined-rack structure.

Certain terminology will be used in the following description for convenience in reference only and will not be limiting. The words "left" and "right" will designate positions in the drawings to which reference is made. Said terminology will include the words above specifically mentioned, derivatives thereof and words of similar import.

Figure 2:
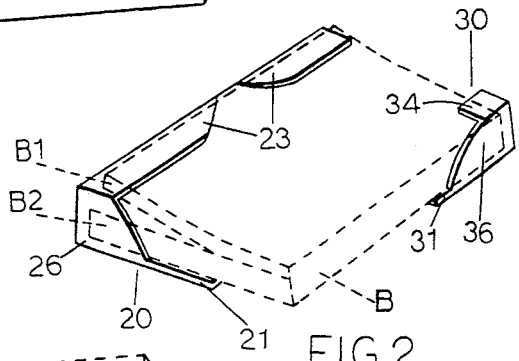
FIG. 2 is a reduced perspective view illustrating the use of the holder as a bookmark by means of an enclosed-rack structure.
Figure 3:
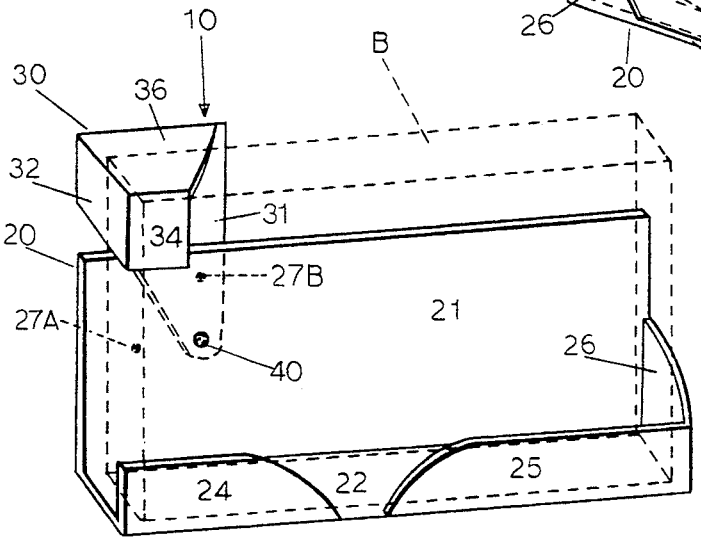
FIG. 3 is a perspective view illustrating the use of the enclosed-rack holder engaging the book therein.
Figure 4:
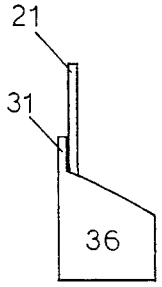
FIG. 4 is a side elevation view of the combined-rack structure shown in FIG. 1.
Figure 5:
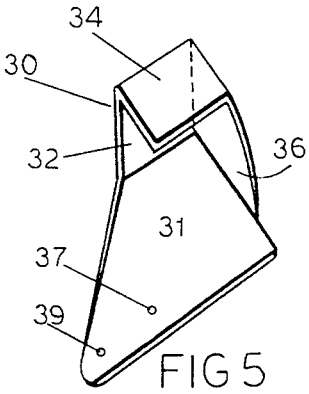
FIG. 5 is a perspective view of the left rack of the holder.
Figure 6:
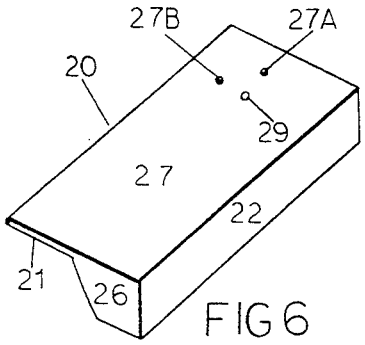
FIG. 6 is a reduced perspective view showing the rear of the right rack of the holder.

Referring now to the drawings, FIGS. 1–3 illustrate a book holder 10 comprising a pair of open-end right and left racks 20 and 30, molded out of rigid sheet material and coupled to each other by a rivet 40 through respective round apertures 29 (FIG. 6) and 39 (FIG. 5), and so designed as to pivotally form a combined closed-end rack structure sufficiently large to hold open a book B and a diagonally enclosed-rack structure for storing and carrying a book.

Right rack 20 comprises a flat elongated rectangular back 21 with the same length dimension as but shorter width dimension than book B, a platform 22 extending the full length of one side of back 21 and having a width slightly larger than the thickness of book B, a fence collectively designated 23 parallel to back 21, a side wall 26 connecting to back 21, platform 22 and fence 23 at their right inner perimetrical edges to form a closed end 28. Fence 23 comprises two parts 24 and 25, the perimeters of which are arcuate in form at least particularly where they descend at their inner edges towards platform 22.

Left rack 30 comprises a generally quadrilateral arm 31, an aperture 37 adapted to engage either pin 27A or 27B of the rear surface 27 (FIG. 6) of rack 20, another aperture 39 receptive of rivet 40, a fence 34, a base 32 (FIG. 5) so sized as to allow fence 34 position adjacent fence 24 in the same plane, a side wall 36 connecting to arm 31, base 32, and fence 34 at their left inner perimetrical edges to form a closed end 38.

The engagement of pin 27A and pin 27B into aperture 37 interlockingly secures respective said combined-rack and enclosed-rack structures, whereby book B can be maintained in an open position (FIG. 1), can be stored or carried by being simply placed on platform 22 either with the spine up or the opened edge up as shown in FIG. 3. When it is desired to mark the page at which a reader stopped reading or to which the reader wishes to refer to at a later date, the read and unread pages, B1 and B2, can be placed separately on both sides of fence 23 before the book is substantially enclosed by both racks as shown in FIG. 2.

The present embodiment of this invention is thus to be considered in all respects as illustrative and not restrictive; the scopes of the invention are indicated by the appended claims rather than by the foregoing description. All changes which come within the meaning and range of equivalency of the claims are intended to be embraced therein.

What is claimed is:

1. A holder and carrier for a book, comprising:

a. a short rack member and a long rack member, the short rack member having one closed left end and an open right end, the long rack member having one closed right end and an open left end;

b. pivoting means pivotally securing the short rack member to the long rack member;

c. detent means located on both rack members; wherein when the short rack member pivots toward the long rack member, with the closed end of the short rack member moving toward the open end of the long rack member, forms a first closed-end structure to hold and support the book in an open position, and when the short rack member pivots away from the long rack member, forms a second diagonally enclosed rack structure to enclose the book and being used as a carrier and bookmark.

2. The holder of claim 1 wherein said long rack comprises:

a. a rectangular elongated back having a length slightly exceeding that of said book and a width about equal to one-half of that of said book, and b. a platform perpendicular to an inner lower side of said back and extending the full length thereof, having a width slightly greater than the thickness of said book, and c. first and second spaced apart upstanding fences to said platform lying substantially in a same vertical plane and high enough to contain the pages of said book, each fence having an inwardly disposed contoured edge which descends toward said platform adjacent to the spine of said held book to facilitate turning over of a page, and d. a right side wall connecting with each rightmost inner perimetrical edge of said back, said platform and said first fence,thereby defining the right closed end of said long rack, one side of said right wall being substantially higher than the other side thereof and descending toward said first fence to prevent right-hand pages of said book from extrusion from said right closed end, and e. said left open end defined by each outer edge of said back, said platform, and said second fence, and f. at one upper part of a rear surface of said back, first round aperture, first and second round pins spaced apart from one another so as to participate in defining said pivotal and detent means.

3. The holder of claim 1 wherein said short rack comprises:

a. a generally quadrilateral arm having first side about equal to two-third of the width of said back, second side about twice as long as third side which is equal to an extension length serving to form said first structure, said first side perpendicular to said second and third sides which are connected to each other by fourth side, whereby the junction of second and fourth sides is inwardly curved into an archlike shape, and b. third upstanding fence parallel to said arm, having the same height dimension as said second fence, and the same length dimension as said third side, and c. a rectangular base perpendicularly connecting with said third side and said third fence, having a width sized to permit said third fence position adjacent said second fence in said same vertical plane, and a length equal to said extension length so designed as to make said first structure sufficiently long to hold open said book therein, and d. left side wall connecting with each rightmost inner perimetrical edge of said base, said third side, and said third fence, thereby defining said left closed end of said short rack, one side of said left wall being substantially higher than the other side thereof and descending toward said third fence to prevent left-hand pages of said book extrusion from said left closed end, and e. said right open end defined by each outer edge of said arm, said base, and said third fence, and f. at one upper part of said arm, second round aperture and a pin-receiving hole spaced from each other another so as to participate in defining said pivotal means and said detent means.

4. The holder of claim 1 wherein said pivotal means comprises a rivet and the detent means comprises first and second apertures to permit said two racks pivot therearound.

5. The holder of claim 1 wherein said long rack member having a back surface adapted to receive advertising matters.

6. The holder of claim 1 wherein said two racks are molded out of rigid, preferably transparent, sheet material.

* * * * *